United States Patent [19]

Soul-Sun Goe

[11] Patent Number: 4,996,780

[45] Date of Patent: Mar. 5, 1991

[54] METHOD AND APPARATUS FOR DRYING BRINE SHRIMP CYSTS

[76] Inventor: Simon Soul-Sun Goe, No. 1 Main St., Snowville, Utah 84336

[21] Appl. No.: 183,143

[22] Filed: Apr. 19, 1988

[51] Int. Cl.[5] ..... F26B 5/08

[52] U.S. Cl. ..... 34/8; 34/139; 34/58; 34/17

[58] Field of Search ..... 34/131, 132, 133, 139, 34/22, 17, 8, 58

[56] References Cited

U.S. PATENT DOCUMENTS

| | | | |
|---|---|---|---|
| 2,148,057 | 2/1939 | Chamberlain | 34/139 |
| 2,500,062 | 3/1950 | Clark | 34/139 |
| 2,543,279 | 2/1951 | Erwin | 34/139 |

*Primary Examiner*—Henry A. Bennet
*Attorney, Agent, or Firm*—A. Ray Osburn

[57] ABSTRACT

A method, and associated apparatus, for drying harvested brine shrimp cysts for storage for subsequent hatching for fish food. The cysts are washed with fresh water, and strained through a sieve to remove foreign material, flotation separated to eliminate dead cysts, strained out of the water, dewatered centrifugally and finally dried in a special apparatus which prevents any caking of the cysts together. The drying apparatus includes a drum with cyst-retaining porous walls, mounted on its side to rotate in a vented housing about its longitudinal axis. Drying air is blown into the rotating drum, exiting through the porous walls, drying the cysts without caking.

3 Claims, 7 Drawing Sheets

METHOD AND APPARATUS FOR DRYING BRINE SHRIMP CYSTS

BACKGROUND OF THE INVENTION

1. Field:

The field of the invention is apparatus and methods for preparation of the cysts of the brine shrimp (Artemia spp.) to be containerized for storage, shipment and later hatching into nauplii for use as fish food.

2. State of the Art:

Developing brine shrimp are in nature contained within protective spherical cysts. The cysts are found floating in the dense concentrated brine, for example, of the Great Salt Lake, Utah, and are harvested by seining and bagging. As originally harvested, the bagged cysts are accompanied by various lake and shore detritus and flotsam, as well as water and salt, and must be washed and seived with fresh water to remove the salt and debris. Since whole, viable cysts will not float in fresh water, as will broken dead cysts, a settling and skimming may be employed to dispose of the latter. The water is then drained off through a fine mesh seive which retains the viable cysts. The cysts may then be bagged and further dewatered in a centrifugal spin tank.

After dewatering, the cysts must be further dried before being placed in sealed cans for storage and shipment. Heretofore, the damp mass of cysts has been spread in thin layers in trays and allowed to dry. Both atmospheric and oven drying environments have been utilized. Periodic manual stirring of the mass of cysts is sometimes used. With these procedures, individual cysts become caked together into a crumbly aggregate. However, the cysts must somehow later be separated before hatching, or the cake at least crumbled to reasonably small clumps of aggregated cysts. This breaks and destroys substantial numbers of the cysts. There is therefore a definite need for a method of brine shrimp cyst preparation for canning which is more efficient in terms of surviving cysts.

BRIEF SUMMARY OF THE INVENTION

With the foregoing in mind, the present invention eliminates or substantially alleviates the disadvantages and shortcomings in the prior art of shrimp cyst preparation for canning. Harvested cysts are first washed and sieved with fresh water to remove foreign matter, then dewatered by gravity draining and centrifugal extraction. The clean but still quite wet and soggy cysts are then dried in a special apparatus, which produces loose, separately dried, uncaked cysts ready for placement into cans.

The apparatus comprises a rotatable elongate drum mounted so that its longitudinal axis is horizontal. A stream of warm drying air is introduced into the interior of the rotating drum, to exit through a fine mesh screen comprising a portion of the wall of the drum. The screen retains the cysts while permitting air passage. Preferably, a stationary air inlet tube is provided, mounted in sealed relationship to the rotating drum, facilitating the connection of a flexible warmed air supply duct. The rotating drum constantly raises and drops the cysts through the drying air in the space within the drum, maintaining the individual cysts in constantly relative motion. This prevents the cysts from cementing together as happens with other drying methods. Preferably, the oven further comprises a stationary housing about the drum, with exit vents for moisture-laden used drying air. Preferably, the housing is mounted to be tilted from the horizontal to facilitate loading and unloading of the cysts.

It is therefore the object of the invention to provide an improved method and associated apparatus for preparing brine shrimp cysts for canning, and to minimize damage to the cysts and increase the yield of viable cysts in the finished product.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
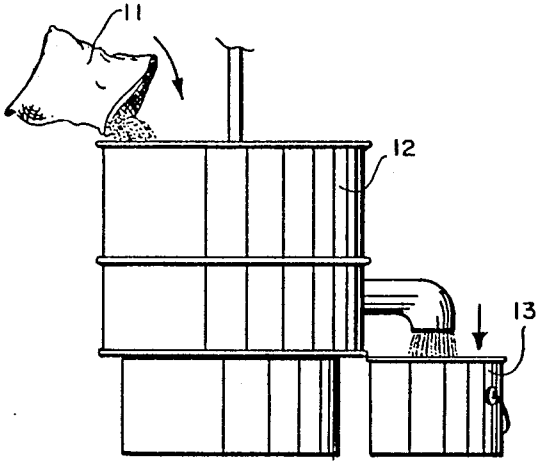
FIG. 1 is an elevational view of a washing and screening tank being used to screen out foreign matter from the harvested shrimp cysts, the mixture of water and cysts passing the screen shown being deposited into a settling container, drawn to a reduced scale, FIG. 2 the settling container of FIG. 1 shown in use, the broken cysts being seined from the top thereof and the sound cysts settling to the bottom thereof, drawn to a larger scale than FIG. 1, FIG. 3 the fine mesh cyst net being shown in operation, straining the cysts from the mixture of water and cysts remaining after the settling illustrated in FIG. 2, drawn to a larger scale than FIG. 1, FIG. 4 an elevational view of a centrifugal water extraction apparatus, cotton bags of cysts as retained by the net of FIG. 3 shown being placed therein, drawn to approximately the scale of FIG. 1, FIG. 5 the centrifugal device of FIG. 4 illustrated extracting water from the bagged cysts, partially cut away, drawn to the scale of FIG. 4, FIG. 6 a side elevational view of a shrimp cyst drier in accordance with the invention, a bag of cysts from the centrifugal extractor of FIG. 5 shown being placed thereinto for drying, said drier being tilted to facilitate loading, drawn to a reduced scale, FIG. 7 the drier of FIG. 6 during operation, being returned to level to evenly distribute the cysts therein, drawn to the scale of FIG. 6, FIG. 8 the drier of FIG. 7 shown being emptied of dried cysts, tilted to facilitate the cyst removal, drawn to the scale of FIG. 6, FIG. 9 a side elevational view of a shrimp cyst drier in accordance with the invention, shown connected to a drying air supply duct, drawn to a reduced scale larger than that of FIG. 6, FIG. 10 a vertical sectional view of the drier of FIG. 9, taken through the longitudinal axis of the drum thereof, drawn to the same scale, FIG. 11 a front elevational view of a fragment of the drier of FIG. 9, taken along line 11—11 thereof, drawn to the same scale, FIG. 12 a rear elevational view of a fragment of the drier of FIG. 9, taken along line 12—12 thereof, partially cut away to show the drive chain and sprocket, drawn to the same scale, FIG. 13 an enlarged view of a fragment of the drier of FIG. 10, FIG. 14 an enlarged view of another fragment of the drier of FIG. 10, drawn to the same scale as FIG. 13, FIG. 15 a vertical cross sectional view of the drum of the drier of FIG. 10, taken along line 15—15 thereof, indicating the stirring of the cysts during drying and the flowing of air through the drum, drawn to the scale of FIG. 10, FIG. 16 a front perspective view of a fragment of the cylindrical wall of the drum of FIG. 10, showing the perforated cylindrical backing member and the covering fine mesh screen, drawn to a larger scale than FIG. 10.
Figure 2:
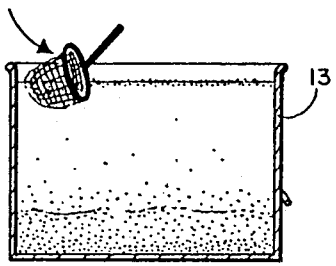
Figure 3:
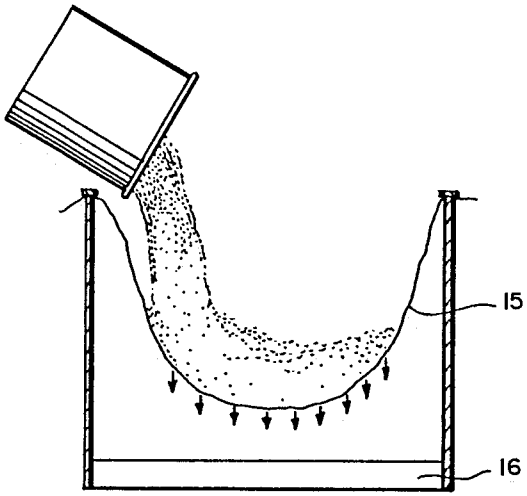
Figure 4:
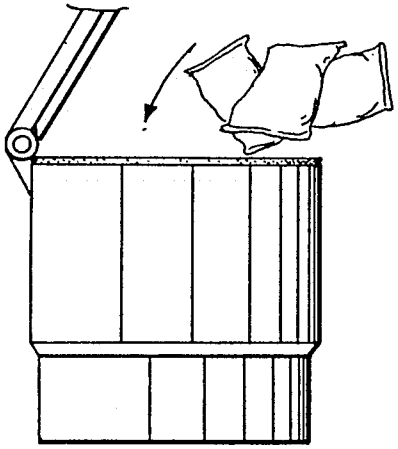
Figure 5:
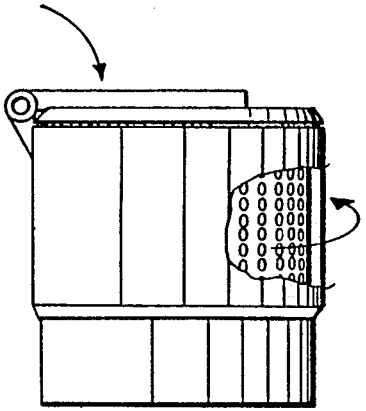

The inventive method and apparatus 10 for processing brine shrimp cysts is illustrated in the drawings. The viable cysts, seined from their natural habitat and delivered in plastic, water-permeable bags 11 for processing, must first be freed of foreign materials and damaged cysts. The necessary preliminary cleaning and washing steps are illustrated in FIGS. 1-5. The cysts are first mixed with fresh water and passed through a vibrating mesh screen, not shown, in a screening tank 12 to remove the larger sized foreign objects. The mixture of water and cysts which passes through the debri screen is then placed in a settling container 13. Any damaged broken cysts rise to the top of the fresh water, to be removed with a debri net 14. The sound viable cysts settle in the fresh water to the bottom of container 13. The water/cyst mixture can then be dewatered by pouring it into a cyst strainer, 120-mesh, net 15, which retains the cysts and allows the water to drain into a pan 16. The retained cysts are scooped from net 15 into cotton bags 17, which are placed into a centrifugal spinning device 18 to further dewater the cysts.

Figure 7:
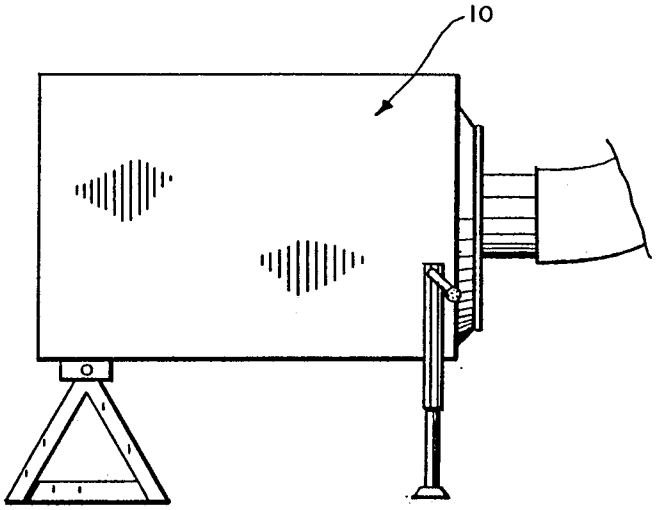
Figure 6:
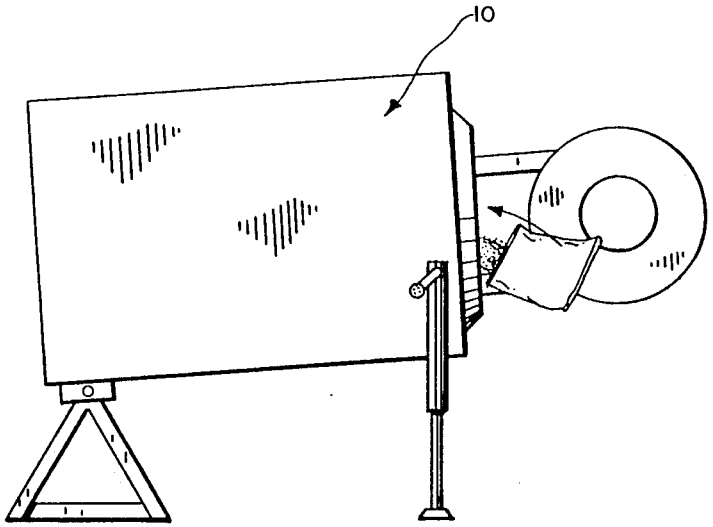

After spinning, the cysts are still quite damp, but are ready for final drying, the most critical step in preparation for canning. As previously discussed, with prior art final drying methods the cysts cake together resulting in eventual fatal damage to many cysts. To prevent this caking, final drying apparatus 10 is provided, illustrated in use in FIGS. 6-8 and in detail in FIGS. 9-16.

Figure 9:
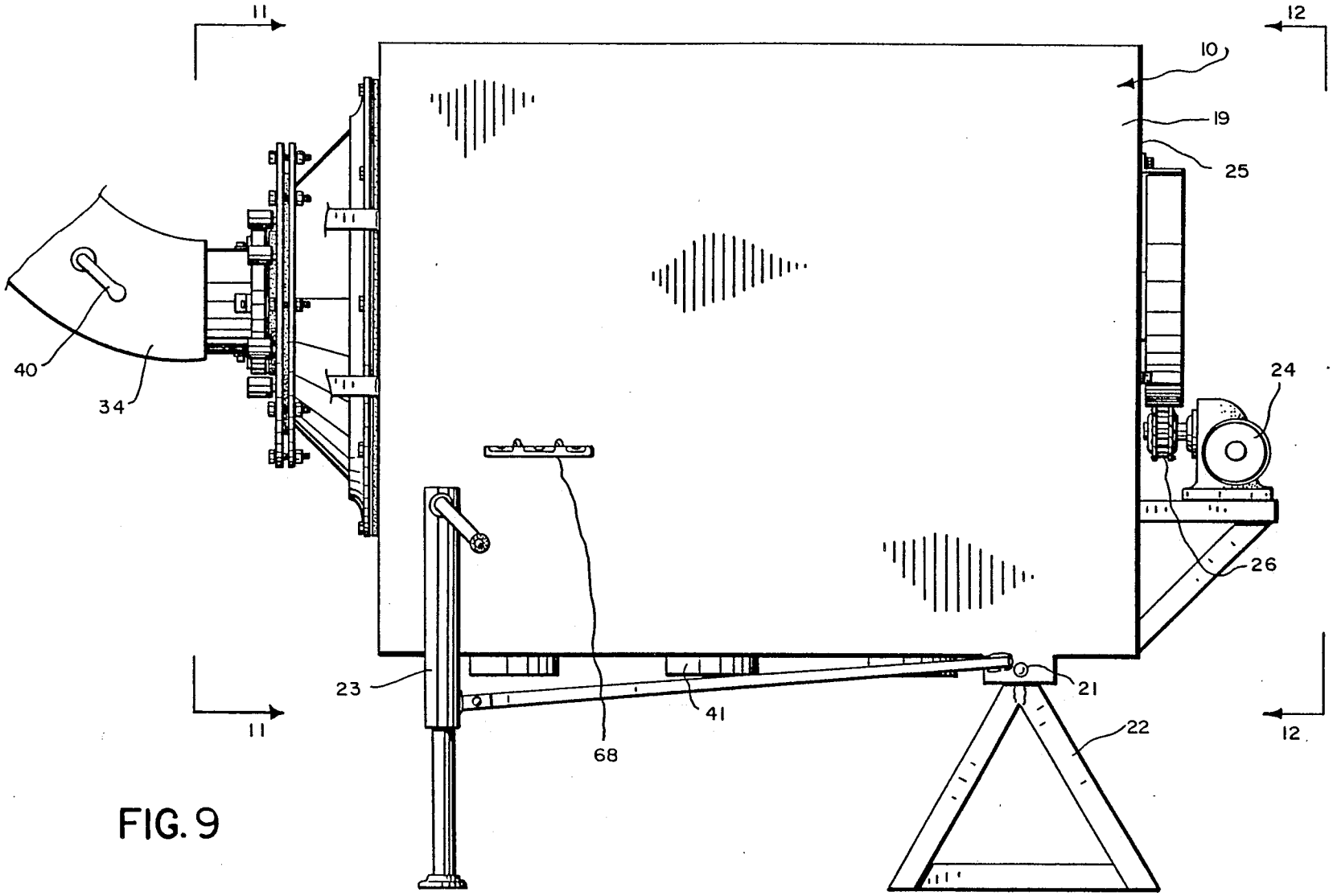
Figure 10:
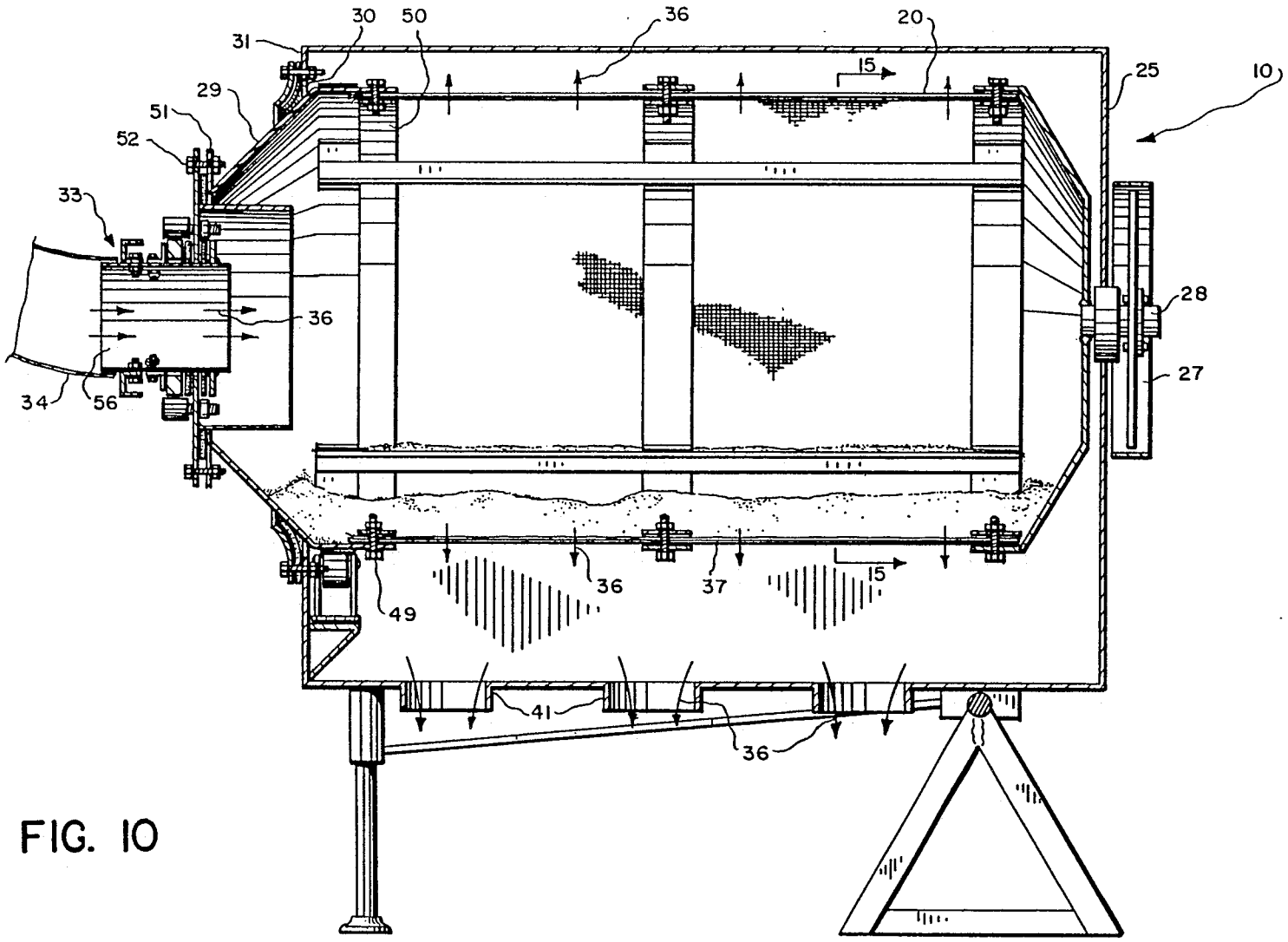
Figure 12:
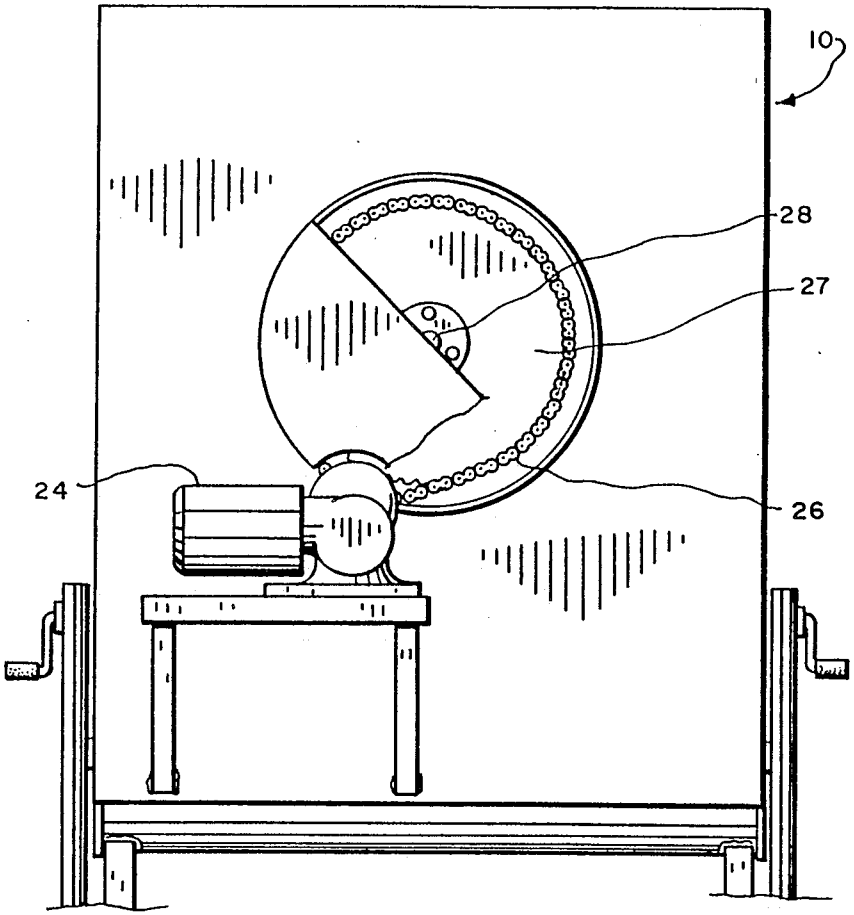
Figure 11:
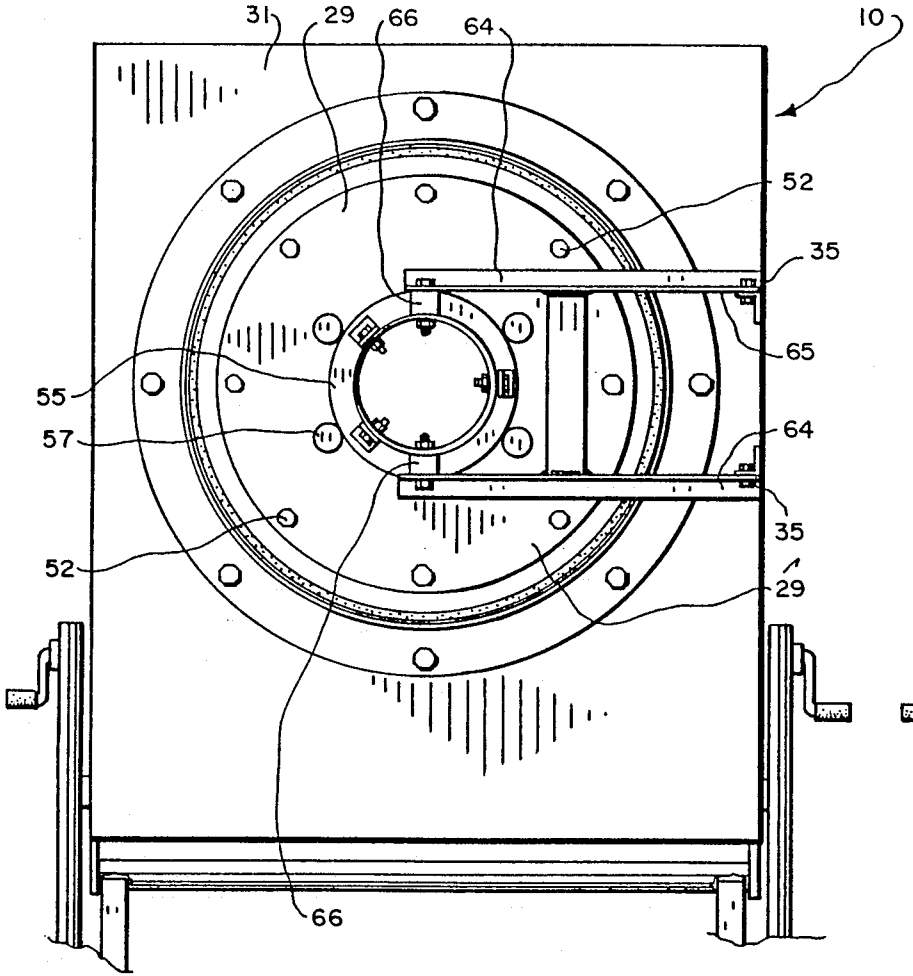
Figure 15:
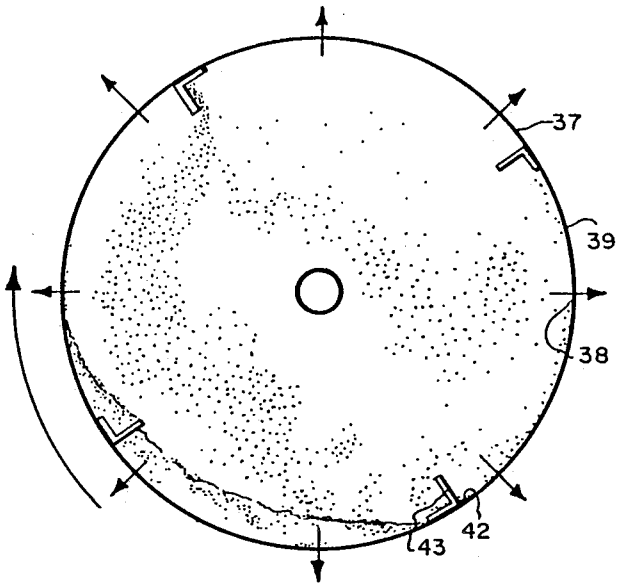
Figure 16:
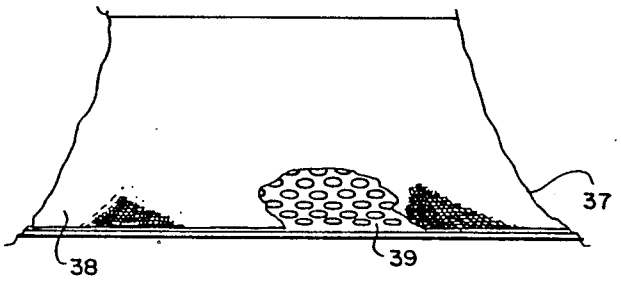

Drier 10 comprises a stationary exterior housing 19 and an interior drum 20 mounted rotatably therein. (FIGS. 9 & 10) Housing 19 is supported at its rearward end by transverse horizontal pivots 21 upon an angle iron triangular support 22, and at its forward end upon a pair of adjustable legs, such as the jacks 23. A motor 24, bracketed to rear wall 25 of housing 19, acts through a chain 26, sprocket 27, and drive shaft 28 to rotate drum 20. (FIGS. 10 & 12)

Figure 13:
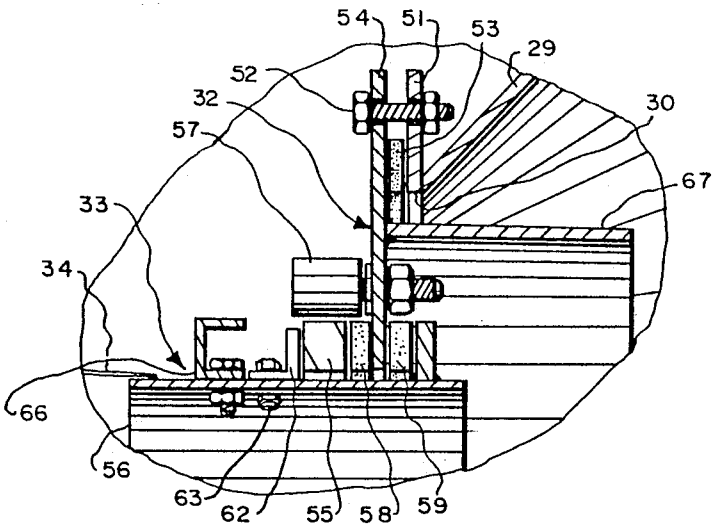
Figure 14:
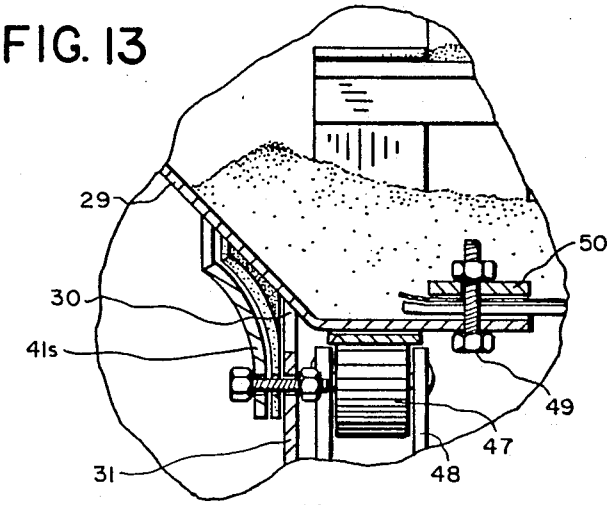

Conical front end closure 29 of drum 20 protrudes through circular hole 30 in housing front wall 31. (FIGS. 10, 11 & 14) Protruding drum closure 29 carries a hinged access door assembly 32. Air inlet assembly 33 on door 32 connects to a flexible warm air supply duct 34. (FIGS. 9, 10 & 13)

The dewatered but damp cysts are emptied from cotton bags 17 into the interior of drum 20. Access door assembly 32 is then pivoted closed about hinges 35. (FIGS. 6 & 7) Warmed air (arrows 36) is then allowed to flow from air supply duct 34 through air inlet 33 into the interior of drum 20, which is now rotated by motor 24 through chain 26 and sprocket 27. The drying air 36 flows out of drum 20 through cylindrical drum wall 37. Wall 37 comprises a fine mesh screen 38 supported on its outer side by a perforated metal cylinder 39. (FIGS. 10, 15 & 16) Being of 120 mesh, screen 33 retains individual cysts. Very little pressure is required in drum 20 because of the large exposed area of screen 38. The flow of incoming air may be controlled by damper 40 on supply duct 34. Vents 41 through housing bottom wall 42 assure circulation of the light weight warm air throughout the interior of housing 19 around drum 20. A flexible seal 41s, bolted to housing front wall 31, prevents air leakage through opening 30 around cone 29.

As drum 20 turns, the mass of cysts tends to follow wall 37 because of shearing friction with screen 38, but falls away when raised sufficiently. (FIG. 15) Protruding legs 43 of longitudinal drum stiffening angles 44 also help to raise the cysts to fall through the free air space inside drum 20. (FIG. 15) The drying air, forced to exit through the entire surface of cylindrical wall 37, is directed to flow throughout the interior of drum 20. The still damp cysts are thus evenly exposed to the flow of drying air. The drying process however includes heating the cysts by conduction from the drum walls, inducing evaporation of moisture which is then carried from drum 20 by the flow of air 36. The constant stirring from drum rotation assures even heating of the mass of cysts.

Because the individual cysts are never permitted to be in sustained stationary contact, no cementitious adherence (caking) of the cysts together can occur. Each individual cyst is thus equally and individually dried, remains completely separated, and exists unconnected and autonomous. Very few of the cysts are broken, since no forceable separation is employed as with other drying methods. The recovery factor in terms of intact viable cysts is therefore very high.

To prevent loss of the 245 micron diameter cysts to the atmosphere, drum 20 is provided with rotating seals. At the rear housing wall 25, blind hub 45 accepts the end of drive shaft 28, precluding any need for a rotating seal. Such a seal must however be provided at the front end of drum 20, as described below.

At its front end, drum 20 rides through race collar 46 upon a pair of bearing wheels 47 mounted upon brackets 48 on front wall 31 of housing 19. (FIGS. 10 & 14) Conical end closure 29 of drum 20 is secured by bolts 49 acting through inside collar 50, to the front end of drum cylindrical wall 37. A flange 51 is welded to the small end of cone 29, to which bolts 52 secure access door assembly 32 sealed by an annular gasket 53.

Access door assembly 32 comprises annular main door plate 54 and air inlet assembly 33. During operation of drier 10, main plate 54 rotates with end cone 29 and drum 20. Air inlet assembly 33 remains stationary, supported through raceway 55 around tube 56 upon several rotating bearings 57, which are circularly placed on door plate 54. (FIGS. 10, 11 & 13) Air and cyst leakage about tube 56 is prevented by tube gaskets 58 and 59, which press elastically against the tube exterior surface. Sealing contact between elastic gaskets 59 and 58 and door plate 54 is maintained by tube flange 61 and raceway 55 respectively. Raceway 55 is retained by circularly formed angle flange 62, removable from tube 56 by bolts 63. Gaskets 59 and 60 are preferably of highly lubricous material, such as Teflon.

Members 64 of hinge frame 65 are bolted to channels 66 in turn bolted to tube 56. (FIGS. 11 & 13) Frame 65 is connected through hinges 35 to housing front wall 31.

To open door assembly 32, bolts 52 are removed to free plate 54 from flange 51. Door 32, along with inlet tube 33, is rotated about hinges 35, freeing end opening 67 for drum access.

A cyst deflection shield 68 is welded to door plate 54 to prevent accumulation of cysts in the area of rotating seals 58 and 59. (FIG. 13) Shield 68 may be tapered to prevent accumulation of cysts upon its upper surface.

Figure 8:
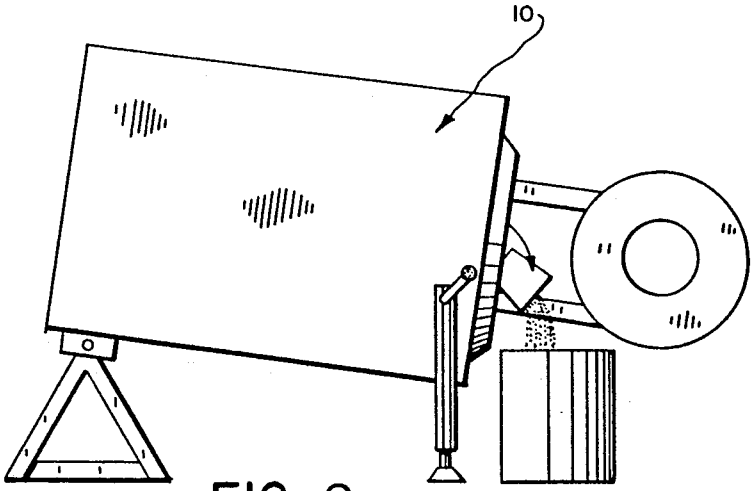

The pivotal mounting of housing 19 facilitates both the loading and unloading of drum 20. For loading, housing 19 is tilted by jacks 33 to raise its front end, providing an internal slope causing the cysts to vibrate rearwardly from drum end opening 67. (FIG. 6) After being loaded, housing 19 is returned to horizontal to evenly distribute the cysts during the drying cycle. Spirit levels 68 are provided on the sides of housing 19. (FIG. 7) To remove dried cysts, the jacks are lowered causing the cysts to flow forwardly, to be easily scooped out into buckets. (FIG. 8)

Figure 17:
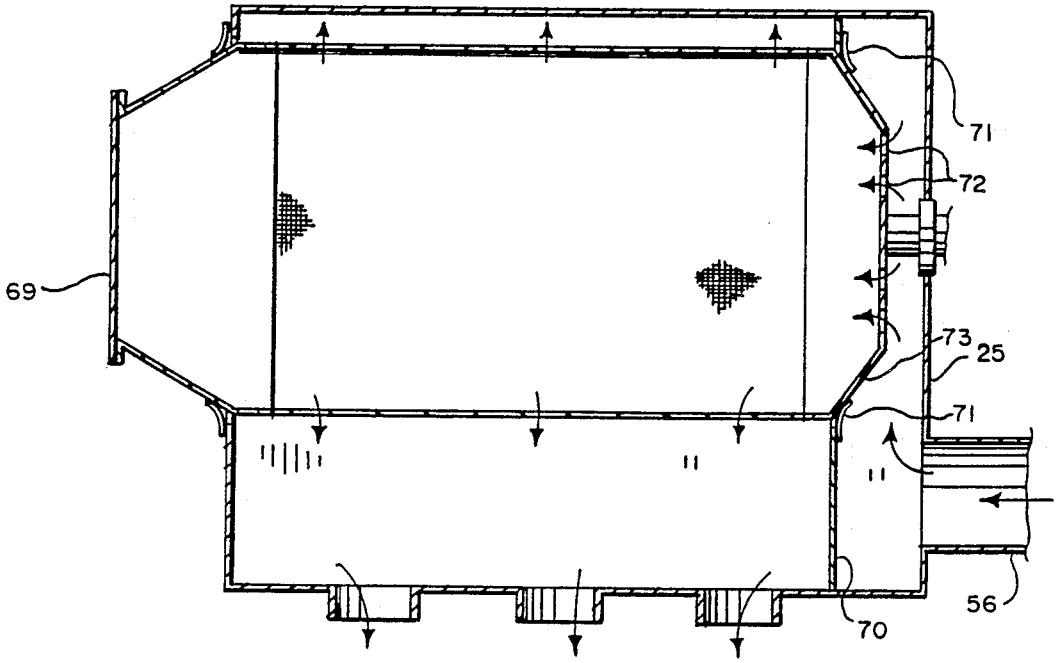
FIG. 17 a representation of another preferred embodiment of a drier in accordance with the invention, drawn to a reduced scale, and FIG. 18 a representation of still another preferred embodiment of a dryer in accordance with the invention, drawn to the scale of FIG. 17.
Figure 18:
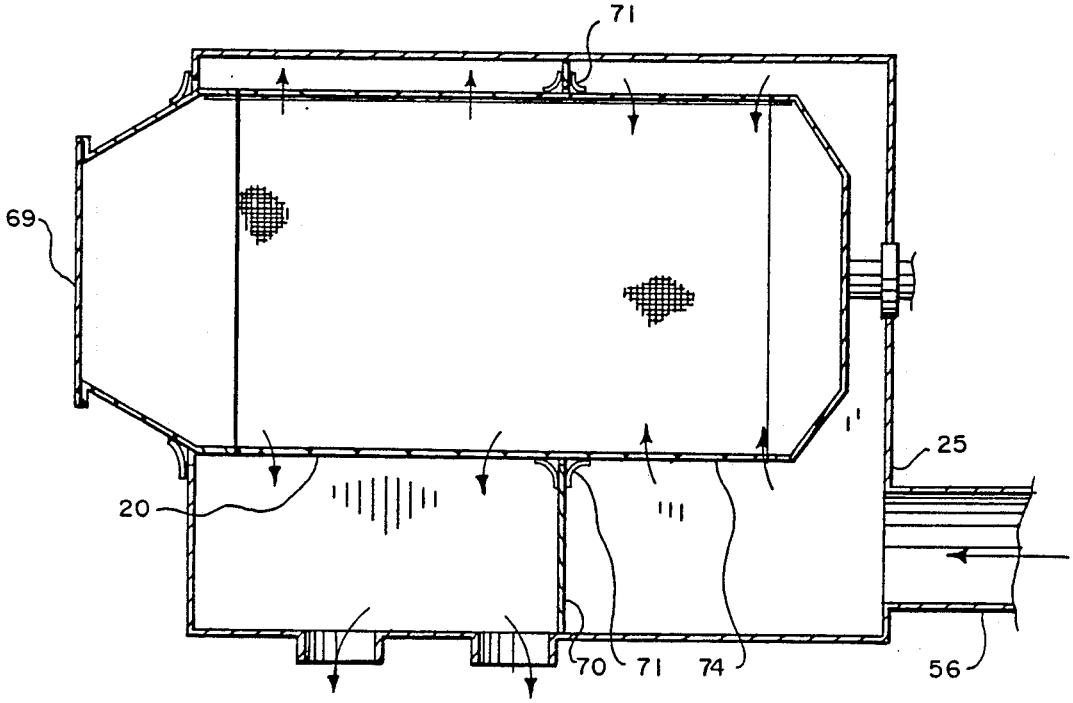

The spirit of the invention encompasses variations from the embodiment described herein. For example, the problem of cyst loss from the rotating drum could be solved not by the door assembly illustrated, but by providing a rotating seal, not shown, between the end of the duct 34 and the tube 56. Or, door assembly 32 could be replaced with a circular plate 69, and air inlet tube 56 placed instead on rear housing wall 25. (FIG. 17) Housing partition 70 with seal 71 is added to direct the air into drum 20 through inlet orifices 72 in rear drum closure 73. In another variation (FIG. 18) the air could even enter into drum 20 through the portion 74 of screen 38 rearward of partition 70. Although drying would be much less efficient, cake free dried cysts could even be produced without housing 25. The tilt mounting arrangement, although very advantageous, is not essential to production of such dried cysts. And, other means of rotating drum 20 would conform also to the spirit of the invention.

The inventive apparatus may be embodied in other specific forms, and the method in other specific steps, without departing from the spirit or essential characteristics thereof. The present apparatus and method are therefore to be considered illustrative and not restrictive, the scope of the invention being indicated by the appended claims rather than by the foregoing description and all changes which come within the meaning and range of equivalency of the claims are therefore intended to be embraced therein.

I claim:

1. A method for preparing harvested brine shrimp cysts for storage, shipment and later use as fish food, comprising the steps:

mixing the harvested cysts with fresh water and removing foreign material therefrom by passing the cysts and fresh water through a vibrating screen;

placing the strained mixture of cysts and water into a flotation vessel and removing the floating, broken cysts from the top layer of fresh water by collecting said cysts upon fine mesh material moved as a seine through said top layer;

straining the remaining viable cysts from the fresh water using a fine mesh, cyst retaining net;

placing the retained cysts in the net into cotton bags and further dewatering the bags of cysts in a centrifugal water extraction device;

drying the dewatered cysts from the centrifugal device in a cyst drying apparatus, said apparatus comprising;

a generally closed external housing having a front, a rear, a right side, a left side, a bottom and a top wall;

a generally closed drum having a horizontal longitudinal axis, and a front portion and a rear portion, and being mounted rotatably about said axis within the housing, at least a portion of said drum comprising an air permeable, fine mesh, cyst retaining screen, the remainder thereof being impermeable to air;

means to rotate the drum about said axis;

means for admitting a flow of cyst drying air into the drum; and at least one vent communicating between the space within the interior of the housing exterior to the drum and the atmosphere, so that the drying air may blow from the drum through the screen into the housing and thence to the atmosphere.

2. A method for preparing harvested brine shrimp cysts for storage, shipment and later use as fish food, comprising the steps:

separating the cysts from foreign material;

dewatering the cysts to a damp condition;

placing the damp cysts into a generally closed drum supported to be rotated about a horizontal longitudinal axis thereof, at least a portion of the drum comprising an air permeable, cyst retaining fine mesh screen;

introducing a flow of cyst drying air into the interior of the drum;

rotating the drum while the drying air is flowing therethrough until the cysts are dried to a moisture content suitable for storage; and removing said cysts from said drum for storage.

3. A method for preparing harvested brine shrimp cysts for storage, shipment and later use as fish food, comprising the steps:

separating the cysts from foreign material;

dewatering the cysts to a damp condition;

drying the damp cysts in an apparatus comprising;

a generally closed external housing having a front, a rear, a right side, a left side, a bottom and top wall;

a generally closed drum having a horizontal longitudinal axis, and a front portion and a rear portion, and being mounted rotatably about said axis within the housing, at least a portion of said drum comprising an air permeable, fine mesh, cyst retaining screen, the remainder thereof being impermeable to air;

means to rotate the drum about said axis;

means for admitting a flow of cyst drying air into the drum; and at least one vent communicating between the space within the interior of the housing exterior to the drum and the atmosphere, so that the drying air may blow from the drum through the screen into the housing and thence to the atmosphere.

* * * * *

US004996780C1

(12) REEXAMINATION CERTIFICATE (4279th)

United States Patent

Goe

(10) Number: US 4,996,780 C1

(45) Certificate Issued: Feb. 27, 2001

(54) METHOD AND APPARATUS FOR DRYING BRINE SHRIMP CYSTS

(75) Inventor: Simon Soul-Sun Goe, No. 1 Main St., Snowville, UT (US) 84336

(73) Assignee: Simon Soul-Sun Goe, Snowville, UT (US)

Reexamination Request:
No. 90/005,025, Jun. 25, 1998

Reexamination Certificate for:

| | |
|---|---|
| Patent No.: | **4,996,780** |
| Issued: | **Mar. 5, 1991** |
| Appl. No.: | **07/183,143** |
| Filed: | **Apr. 19, 1988** |

(51) Int. Cl.[7] ..... F26B 5/08

(52) U.S. Cl. ..... 34/323; 34/58; 34/139

(58) Field of Search ..... 34/323, 131, 132, 34/139, 58; 43/1, 4

(56) References Cited

U.S. PATENT DOCUMENTS

| | | | | |
|---|---|---|---|---|
| Re. 35,906 | | 9/1998 | Sanders | 43/6.5 |
| 1,284,007 | | 11/1918 | Whitcomb . | |
| 1,664,098 | | 3/1928 | Yates . | |
| 1,986,548 | | 1/1935 | Wolff | 34/5 |
| 2,148,057 | | 2/1939 | Chamberlain | 34/5 |
| 2,543,279 | | 2/1951 | Erwin | 259/3 |
| 2,899,068 | | 8/1959 | King et al. | 210/402 |
| 3,714,729 | * | 2/1973 | Moise | 43/4.5 |
| 4,038,760 | | 8/1977 | Monck et al. | 34/109 |
| 4,065,253 | | 12/1977 | Bullock | 432/105 |
| 4,137,645 | | 2/1979 | Bullock | 35/35 |
| 4,163,064 | | 7/1979 | Hill | 426/2 |
| 4,190,414 | | 2/1980 | Elmy | 432/46 |
| 4,204,388 | | 5/1980 | Dawson | 56/320.1 |
| 4,247,400 | | 1/1981 | King et al. | 210/531 |
| 4,259,777 | | 4/1981 | King et al. | 29/526 R |
| 4,276,710 | * | 7/1981 | Yunker et al. | 43/4 |
| 4,424,130 | | 1/1984 | King | 210/531 |
| 4,751,002 | | 6/1988 | King | 210/530 |
| 4,839,062 | | 6/1989 | Sanders | 210/776 |
| 5,042,187 | | 8/1991 | Bentzley | 43/6.5 |
| 5,104,668 | | 4/1992 | Cole et al. | 426/285 |
| 5,457,908 | | 10/1995 | Sanders | 43/6.5 |
| 5,491,922 | | 2/1996 | Sanders | 43/6.5 |
| 5,566,492 | | 10/1996 | Swenson | 43/6.5 |
| 5,632,097 | | 5/1997 | Snitchler et al. | 34/61 |
| 5,738,036 | | 4/1998 | Jones | 114/255 |
| 5,743,041 | | 4/1998 | Fitzgerald | 43/6.5 |
| 5,768,820 | | 6/1998 | Bentzley | 43/6.5 |
| 5,836,101 | | 11/1998 | Tuan | 43/4.5 |
| 5,839,216 | | 11/1998 | Baker et al. | 43/6.5 |

FOREIGN PATENT DOCUMENTS

| | | | | |
|---|---|---|---|---|
| 1078602 | | 6/1980 | (CA) | F26B/11/04 |
| 857655 | * | 1/1977 | (FR) . | |
| 1 581 468 | | 8/1977 | (GB) | F26B/11/02 |
| 1 581 468 | | 12/1980 | (GB) | F26B/11/02 |

OTHER PUBLICATIONS

Soregeloos, et al., "Manual for the Culture and Use of Brine Shrimp Artemia in Aquaculture," State University of Ghent, Belgium—Faculty of Agriculture, pp. i–xi, 49–68 (1986).

Jenne, "The Story of the Brine Shrimp", Aquarium Journal, Jul., 1960, pp. 331–336.

McCormick, "Drying", Encyclopedia of Science and Engineering, vol. 5, 2nd edition, 1986, pp. 172–204.

McCormick, "Drying", Kirk–Othmer Encyclopedia of Chemical Terminology—Fourth Ed., vol. 8, 1993, pp. 475–520.

(List continued on next page.)

*Primary Examiner*—Stephen Gravini

(57) ABSTRACT

A method, and associated apparatus, for drying harvested brine shrimp cysts for storage for subsequent hatching for fish food. The cysts are washed with fresh water, and strained through a sieve to remove foreign material, flotation separated to eliminate dead cysts, strained out of the water, dewatered centrifugally and finally dried in a special apparatus which prevents any caking of the cysts together. The drying apparatus includes a drum with cyst-retaining porous walls, mounted on its side to rotate in a vented housing about its longitudinal axis. Drying air is blown into the rotating drum, exiting through the porous walls, drying the cysts without caking.

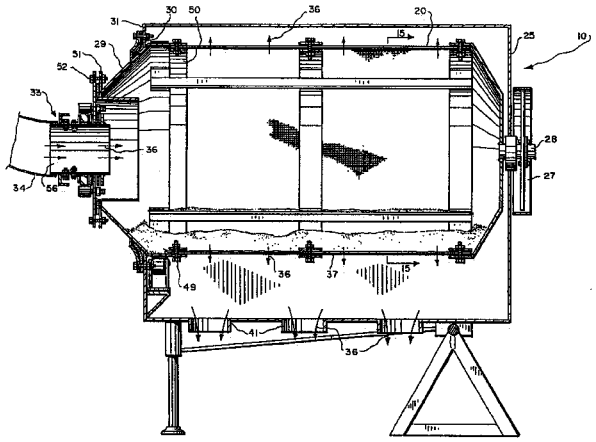

OTHER PUBLICATIONS

Walker, Lewis, McAdams and Gilliland, Principles of Chemical Engineering, 3rd Ed., McGraw Hill, New York, 1979, pp. 292–293.
Badger and McACabe, Elements of Chemical Engineering, 2nd ed., McGraw–Hill, New York, 1936, pp. 560–563.
Estenor, "The Effect of Various Drying Techniques on the State of Diapause and the Hatching Characteristics of Artemia Cysts", 1988–1989, State University of Ghent, Faculty of Agricultural Sciences, Artemia Reference Center, pp. 1–51.
Document entitled, "Eimco Top Feed Pressure Filter Dryer Final Assembly Ca 1955".
Bosteels et al., "Improved Use of the Fluidized Bed Dryer for Atemia Cysts", Aquacultural Engineering, vol. 15, No. 3, p. 169–179, 1996.
D'Agostino, "Revaluation of the Brine Shrimp Project and Other Marine Resources of Christmas Island", United Nations Development Advisory Team for the Pacific, Fiji, 1978.
Dempster, "Brine Shrimp Story", Golden Gate Aquarist, Feb. 1977, pp. 3–8.
Dempster & Hanna, "Preserving Artemia Cysts in High Vacuum", The Aquarium Journal, vol. XXVII, No. 3, Mar. 1956, pp. 10–11.
Dempster, "Separating Brine Shrimp Eggs", California Academia of Sciences, The Aquarium Journal, May, 1946.
VanHaecke & Sorgeloos, "International Study on Artemia. XVIII. The Hatching Rate of Artemia Cysts—A Comparative Study", Aquacultural Engineering 1 (1982) 263–273.
Garrett, "A Study on Hatching of Atemia Salina of Great Salt Lake", Master's Thesis, Department of Science and Education, University of Utah, Aug. 1960, pp. 1–49.
Vanhaecke, "Vergelijkende Studie Van Diverse Geografische Rassen Van Het Pekelkreeftje, ARETMIA, Ter Verbetering Van Zijn Gebruik in de Aquakultuur", Rijksuniversiteit Gent, Fakulteit Van De Landbouwwetenschappen Adademiejaar 1982–83, pp. 73–226.
Fishery Leaflet 527, "Brine Shrimp", United States Department of the Interior, U.S. Fish and Wildlife Service, Bureau of Commercial Fisheries, Washington, DC 20240, Sep., 1961, pp. 1–4.
Currier, Klee & Smith, "Beginner's Guide to Brine Shrimp", San Francisco Aquarium Society Special Publication No. 8, San Francisco, CA (1972).
Rakowicz, "Notes on Atemia Salina", Prawn Farming Systems Techniques, Jun. 25–Sep. 5, 1975, Food Institute, East–West Center.
Drinkwater & Clegg, "Experimental Biology of Cyst Diapause", Atemia Biology, Chapter 5, pp. 93–117, CRC Press, 1991.
Woolf, "Direct to Malaysia: Utah Brine Shrimp Feed Asia Industry", The Salt Lake Tribune, pp. E1 & E8, May 24, 1998.
Dempster, "The Use of Larval and Adult Brine Shrimp in Aquarium Fish Culture", California FIsh and Game, vol. 39, No. 3, Jul., 1953, pp. 355–364.
Zmora & Popper, "The Appearance of Two Types of Artemia Cysts in the Salt Ponds of Elat, Israel: Practical Aspects of Collection, Processing and Usage", Israel Journal of Zoology, vol. 33, 1984/85, pp. 167–180.
McCormick, "Gas Velocity Effects on Heat Transfer in Direct Heat Rotary Dryers", Chemical Engineering Process, Jun. 1962, pp. 57–61.
McCormick, "Answers to 10 Questions About Drying", Powder and Bulk Engineering, Apr., 1992, pp. 43–48.
Internation Study on Artemia by Van Haecke et al. (1982) pp. 263–273.*
Principles of Chemical Engineering by Walker et al. (1937) pp. 292–293.*
"Shrimp Farmers Seine Ponds" by G. Faulkner, Fish Farming News Jan./Feb. 1998.*
Proceedings of the 10th annual World Mariculture Society meeting, Jan. 22, 2979, 1979.*

* cited by examiner

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–3 is confirmed.

New claims 4–17 are added and determined to be patentable.

*4. A method for drying brine shrimp cysts comprising the steps of:*

*(a) washing the cysts to remove foreign material therefrom,*

*(b) dewatering the cysts to a damp condition,*

*(c) placing the cysts into a dryer, the dryer including:*

*(i) a generally horizontal and generally closed drum having a longitudinal axis, said drum having has a cylindrical portion that is permeable to air, a first end and a second end,*

*(ii) a fine mesh screen located on the interior of said drum in order to retain brine shrimp eggs therein while said dryer is in use,*

*(iii) a door securable to said drum at one of said first end and said second end in order to retain brine shrimp eggs in said drum while said dryer is in use, and*

*(iv) an air inlet tube located at one of said drum first end and said drum second end, said air inlet tube being configured to receive warm air through ducting from a remote warm air supply in order to direct warm air into the interior of said drum,*

*(d) rotating said drum about its longitudinal axis,*

*(e) introducing air into said drum through said air inlet so that said air enters said drum through one of its ends, contacts brine shrimp cysts located in said drum, and then exits said drum radially through said fine mesh screen, through said air-permeable drum cylinder portion, and thence to the exterior of said drum, and*

*(f) removing brine shrimp cysts from said dryer.*

*5. A method as recited in claim 4 wherein said dryer further includes at least one protruding leg located on the interior of said drum cylindrical portion, said protruding leg serving to raise brine shrimp cysts as said drum rotates, and thereafter to allow the brine shrimp cysts to fall through free space within said drum.*

*6. A method as recited in claim 4 wherein said air inlet is co-axial with said drum.*

*7. A method as recited in claim 4 wherein said dryer further includes rollers on which said drum turns when it is rotated about its longitudinal axis.*

*8. A method as recited in claim 4 wherein said dryer further includes a housing covering at least a portion of said drum.*

*9. A method as recited in claim 8 wherein said housing has at least one vent located on it, said vent being configured to permit air which has exited said drum to pass therethrough to the atmosphere.*

*10. A method as recited in claim 1 wherein said door is securably sealable to said drum.*

*11. A method for processing brine shrimp cysts for later use, the method comprising the steps of:*

*(a) removing foreign material from the brine shrimp cysts,*

*(b) dewatering the cysts to a damp condition,*

*(c) placing the cysts into a rotary drum assembly, the rotary drum assembly including:*

*(i) a generally horizontal and generally closed drum having a longitudinal axis, said drum having a cylindrical portion that is permeable to air, a first end and a second end,*

*(ii) an air permeable, fine mesh, cyst retaining screen located on at least a portion of the interior of said drum cylindrical portion,*

*(iii) a door securable to said drum at one of said first end and said second end in order to retain brine shrimp eggs in said drum while said rotary drum assembly is in use, and*

*(iv) an air inlet tube located at one of said drum first end and said drum second end, said air tube inlet being configured to receive warm air from ducting attached to a furnace in order to cause warm air from the furnace to be fully and completely directed into the interior of said drum where it may contact brine shrimp cysts and reduce their moisture level,*

*(d) rotating said drum about its longitudinal axis,*

*(e) introducing warm air into said drum through said air inlet tube so that said warm air fully and completely enters said drum through one of its ends, contacts brine shrimp cysts located in said drum and reduces their moisture content, and then exits said drum radially through said fine mesh cyst retaining screen and through said drum cylindrical portion, and*

*(f) removing brine shrimp cysts from said rotary drum assembly.*

*12. A method as recited in claim 11 wherein said drum further includes at least one protruding leg located on the interior of said drum cylindrical portion, said protruding leg serving to raise brine shrimp cysts as said drum rotates, and thereafter to allow the brine shrimp cysts to fall through free space within said drum and contact warm air in said drum so that moisture is removed from the brine shrimp cysts.*

*13. A method as recited in claim 11 wherein said removing step (a) further comprises washing said brine shrimp cysts.*

*14. A method as recited in claim 11 wherein said removing step (a) further comprises flotation separation of floatable foreign material from said cysts.*

*15. A method for processing brine shrimp cysts for later use, the method comprising the steps of:*

*(a) washing the brine shrimp cysts to remove foreign material therefrom,*

*(b) dewatering the cysts to a damp condition,*

*(c) placing the brine shrimp cysts into a rotary drum assembly, the rotary drum assembly including:*

*(i) a generally horizontal and generally closed drum having a longitudinal axis, said drum having a cylindrical portion that is permeable to air, a first end, a second end, and free space in its interior,*

*(ii) a fine mesh screen located on the interior surface of said drum cylindrical portion, said screen serving to retain brine shrimp cysts within said drum during use,*

(*iii*) *a door sealably securable to said drum at one of its ends in order to retain brine shrimp eggs in said drum during use,*

(*iv*) *an air inlet tube located on said drum at one of its ends, said air inlet tube being oriented coaxially with said drum longitudinal axis so that air entering said drum through said air inlet tube enters said drum axially, said air tube inlet being configured to be attached to a heating duct in order to receive warm air from the duct which has been provided by a remotely located furnace, warm air from the furnace being directed through the duct, through the air inlet tube and thence axially into the interior of said drum,*

(*v*) *at least one protruding leg located on the interior of said drum cylindrical portion, said protruding leg serving to raise brine shrimp cysts as said drum rotates, and thereafter to allow the brine shrimp cysts to fall through the free space within said drum,*

(*d*) *rotating said drum about its longitudinal axis,*

(*e*) *introducing warm air into said drum through said air inlet tube so that said warm air enters said drum axially through one of its ends, contacts brine shrimp cysts located in said drum in order to reduce the moisture content of the cysts, and then exits said drum radially first through said fine mesh screen and then through said air permeable drum cylindrical portion, and*

(*f*) *removing brine shrimp cysts from said rotary drum assembly.*

*16. A method as recited in claim 15 wherein said drum air permeable cylindrical portion comprises perforated metal.*

*17. A method as recited in claim 15 wherein said rotary drum assembly further comprises* (*vi*) *air ducting for conducting warm air from a heater to said air inlet tube of said drum.*

* * * * *